US011312400B2

(12) United States Patent
Xiao et al.

(10) Patent No.: US 11,312,400 B2
(45) Date of Patent: Apr. 26, 2022

(54) COUPLER ASSEMBLY AND STRADDLE TYPE RAIL TRAIN WITH SAME

(71) Applicant: BYD COMPANY LIMITED, Shenzhen (CN)

(72) Inventors: Zhihong Xiao, Shenzhen (CN); Daolin Li, Shenzhen (CN); Zhicheng Tan, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 427 days.

(21) Appl. No.: 16/474,764

(22) PCT Filed: Jun. 19, 2017

(86) PCT No.: PCT/CN2017/089032
§ 371 (c)(1),
(2) Date: Jun. 28, 2019

(87) PCT Pub. No.: WO2018/120675
PCT Pub. Date: Jul. 5, 2018

(65) Prior Publication Data

US 2019/0344812 A1 Nov. 14, 2019

(30) Foreign Application Priority Data

Dec. 29, 2016 (CN) ..... 201611248916.4

(51) Int. Cl.
*B61G 7/10* (2006.01)
*B61G 9/04* (2006.01)
*B61G 9/20* (2006.01)

(52) U.S. Cl.
CPC ..... *B61G 7/10* (2013.01); *B61G 9/04* (2013.01); *B61G 9/20* (2013.01)

(58) Field of Classification Search
CPC ... B61G 7/00; B61G 7/08; B61G 7/10; B61G 9/00; B61G 9/04; B61G 9/08; B61G 9/20; B61G 11/00; B61G 11/14
See application file for complete search history.

(56) References Cited

U.S. PATENT DOCUMENTS

2008/0264891 A1* 10/2008 Sprave ..... B61G 7/12 213/75 R

FOREIGN PATENT DOCUMENTS

CN 103043072 A 4/2013
CN 106218662 A 12/2016
(Continued)

OTHER PUBLICATIONS

The World Intellectual Property Organization (WIPO) International Search Report for PCT/CN2017/089032 dated Sep. 26, 2017 6 Pages.

*Primary Examiner* — Robert J McGarry, Jr.
(74) *Attorney, Agent, or Firm* — Anova Law Group, PLLC

(57) ABSTRACT

The disclosure discloses a coupler assembly and a straddle type rail train with the same. The coupler assembly includes a mounting base, a buffering mechanism, a folding mechanism, and a coupler head, one end of the buffering mechanism is interconnected movably with the mounting base, the other end of the buffering mechanism is provided with a pull rod, the pull rod is provided with a limiting portion, one end of the folding mechanism is interconnected movably with the pull rod, the folding mechanism is provided with a locking part, the locking part movably cooperates with the limiting portion to lock or release the pull rod, and the pull rod is fixed at a stretching position when the limiting portion is locked by the locking part, and is movable between a folding position and the stretching position when the limit-
(Continued)

S ing portion is released by the locking part; and one end of the coupler head is interconnected with the other end of the folding mechanism.

14 Claims, 7 Drawing Sheets

(56) References Cited

FOREIGN PATENT DOCUMENTS

| | | | |
|---|---|---|---|
| DE | 1141666 | B | 12/1962 |
| EP | 1129920 | A1 | 9/2001 |
| FR | 1386430 | A | 1/1965 |

* cited by examiner

COUPLER ASSEMBLY AND STRADDLE TYPE RAIL TRAIN WITH SAME

CROSS-REFERENCE TO RELATED APPLICATIONS

This application is a national phase entry under 35 U.S.C. § 371 of International Application No. PCT/CN2017/089032, filed on Jun. 19, 2017, which claims a priority to and benefits of Chinese Patent Application Serial No. 201611248916.4, filed on Dec. 29, 2016, the entire content of all of which is incorporated herein by reference.

FIELD

The disclosure relates to the technical field of rail vehicle manufacturing and, in particular to a coupler assembly and a straddle type rail train with the same.

BACKGROUND

In the related art, a coupler cannot be folded, and such a coupler is applicable to high-speed trains with streamline heads (avoiding aerodynamic adverseness to the front). As the front of a train is generally provided with an opening and closing device, in an uncoupled state, the opening and closing device closes to hide the coupler in a body, and only during coupling can the opening and closing device be opened, exposing an coupling end surface of the coupler out of the body, so that the coupler performs coupling. Moreover, as a part of the car body which is made streamline is small in size, when two cars are coupled, the minimum length of the coupler which is exposed out of the body can still ensure that the two coupled cars can pass through a horizontal curve, and therefore, the requirement on the opening and closing device is low.

Furthermore, for a low-floor rail vehicle with low running speed, due to the consideration of comprehensive factors of vehicle body aesthetics, the head does not have to be made streamline, and the width of the head is large. In order to avoid mutual interference between the heads of two coupled vehicles passing through a horizontal curve, a longitudinal gap between the two coupled vehicles should not be less than a certain critical value, that is, a coupling surface of the coupler needs to extend out of the head for a certain distance. If an existing coupler is used, an end portion of the coupler which is exposed outside is long, affecting aesthetics, and if the opening and closing device is utilized to cover it, then the requirement on the opening and closing device is very high. In addition, as a railway has curved sections and slopes, the rail vehicle passing through the railway often cannot ensure the levelness of the connected coupler, and the coupler can be damaged easily due to nonuniform stress.

SUMMARY

An objective of the present disclosure is to at least resolve one of the technical problems in the related art to some extent.

For this purpose, the disclosure proposes a coupler assembly. The coupler assembly has the advantages of simple structure, attractive appearance, good buffering effect, little vibration, long service life and low requirement on an opening and closing device, and can effectively meet the requirement of horizontal curvilinearity of railways and the requirement of slope trafficability.

The disclosure further proposes a straddle type rail train with the coupler assembly.

The coupler assembly according to embodiments of the first aspect of the disclosure includes: a mounting base, where the mounting base is configured to be mounted on a vehicle; a buffering mechanism, where one end of the buffering mechanism is interconnected movably with the mounting base, the other end of the buffering mechanism is provided with a pull rod, and the pull rod is provided with a limiting portion; a folding mechanism, where one end of the folding mechanism is interconnected movably with the pull rod, the folding mechanism is provided with a locking part, the locking part movably cooperates with the limiting portion to lock or release the pull rod, and the pull rod is fixed at a stretching position when the limiting portion is locked by the locking part, and is movable between a folding position and the stretching position when the limiting portion is released by the locking part; and a coupler head, where one end of the coupler head is interconnected with the other end of the folding mechanism, and the coupler head is configured to be connected externally to pull the vehicle.

In the coupler assembly according to the embodiments of the disclosure, by movably interconnecting the folding mechanism and the pull rod and utilizing the effect of cooperation between the locking part of the folding mechanism and the limiting portion of the pull rod, the pull rod is locked or released. When the pull rod is located at the folding position, the locking part and the limiting portion are separated from each other, the pull rod can move between the folding position and the stretching position, and thereby the pull rod can be folded conveniently. When the pull rod is located at the stretching position, the locking part is utilized to lock the limiting portion, so that the pull rod can be fixed at the stretching position, consequently, the coupler assembly can be configured to couple bodies with large head width, the operation process is simple and convenient, and moreover, the requirement on an opening and closing device is low. The coupler assembly has the advantages of simple structure, attractive appearance and low requirement on the opening and closing device.

The straddle type rail train according to embodiments of the second aspect of the disclosure includes the coupler assembly according to the above embodiment.

Additional aspects and advantages of embodiments of the disclosure will be given in part in the following descriptions, become apparent in part from the following descriptions, or be learned from the practice of the embodiments of the disclosure.

REFERENCE NUMERALS OF THE ACCOMPANYING DRAWING

Figure 1:
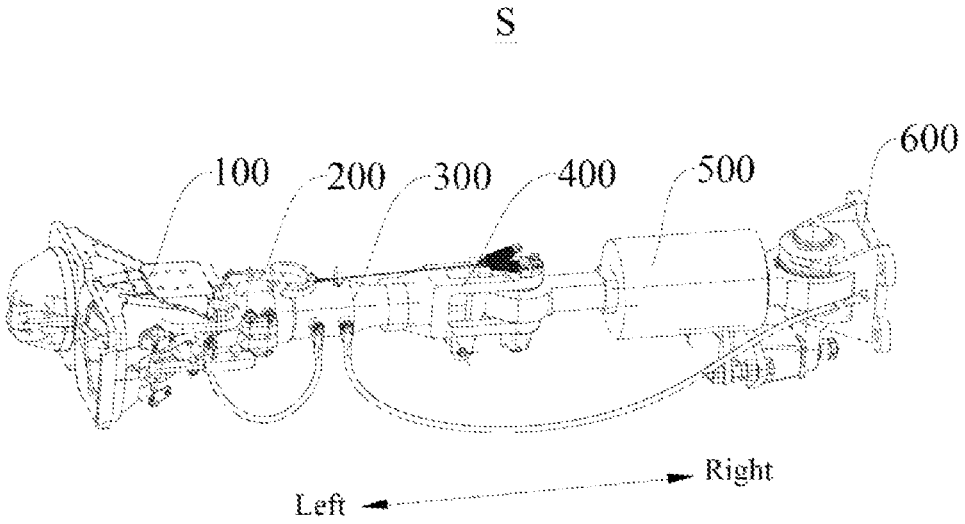
FIG. 1 is a structural schematic diagram of a coupler assembly according to embodiments of the disclosure.
Figure 2:
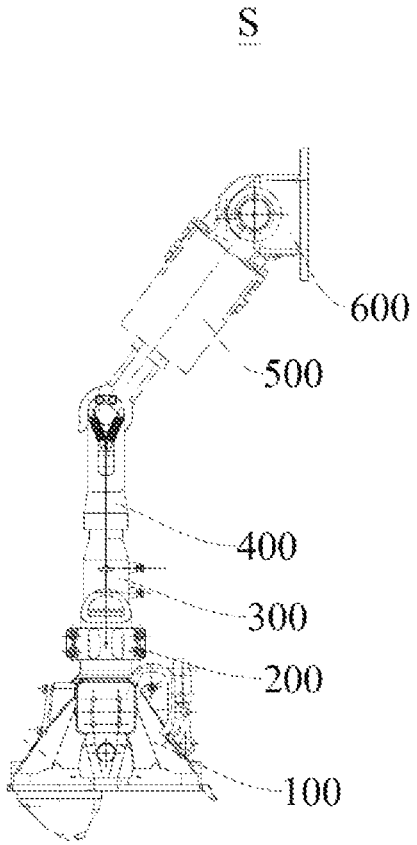
FIG. 2 is a structural schematic diagram of the coupler assembly according to the embodiments of the disclosure at another angle of view.
Figure 3:
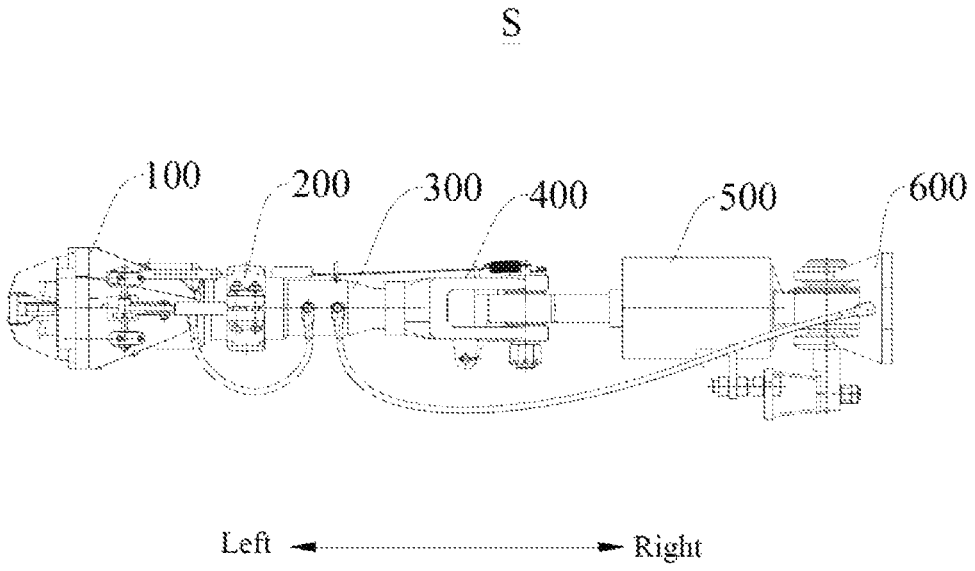
FIG. 3 is a structural schematic diagram of the coupler assembly according to the embodiments of the disclosure at a further angle of view.

S: coupler assembly;
100: coupler head;
110: coupler body;
120: restoring spring;
130: coupler-locking link; 131: limit head;
140: coupler tongue plate; 141: coupler tongue plate limit notch;
150: tapered concave portion; 160: tapered convex portion;
200: snap ring;
300: connecting mechanism;
400: folding mechanism;
  410: swivel arm; 410*a*: first mounting hole; 410*b*: avoiding slot;
411: upper supporting arm;
412: lower supporting arm; 4121: fixing base;
413. connecting base;
  430: locking part; 431: baffle;
  440: pull rope;
  450: elastic part;
500: buffering mechanism;
510: buffer;
511: cylinder; 5111: chamber;
512: connecting portion; 5121: second assembly hole;
513: pull rod;
5131: pull rod body; 5132: movable portion; 5132*a*: second mounting hole; 5132*b*: limiting portion;
5133: bolt;
514: end cap; 515: partition; 516: cushion; 517: fixing nut;
520: supporter;
521: first plate; 522: second plate;
523: rubber part; 524: connecting rod; 525: connecting plate;
527: adjusting nut; 528: fastening nut;
530: articulator;
531: rotary shaft; 532: rubber bearing; 533: sleeve;
600: mounting base.

DETAILED DESCRIPTION

The following describes embodiments of the present invention in detail. Examples of the embodiments are shown in the accompanying drawings. The embodiments described below with reference to the accompanying drawings are exemplary, aim to explain the disclosure, but cannot be understood as a limitation on the disclosure.

A coupler assembly S according to embodiments of the first aspect of the disclosure is first described with reference to FIG. 1-13 in detail below.

The coupler assembly S according to the embodiments of the disclosure includes a mounting base 600, a buffering mechanism 500, a folding mechanism 400, and a coupler head 100.

The mounting base 600 is configured to be mounted on a vehicle, a first end of the buffering mechanism 500 is interconnected movably with the mounting base 600, a second end of the buffering mechanism 500 is provided with a pull rod 513, and the pull rod 513 is provided with a limiting portion 5132*b*. A first end of the folding mechanism 400 is interconnected movably with the pull rod 513, the folding mechanism 400 is provided with a locking part 430, and the locking part 430 movably cooperates with the limiting portion 5132*b* to make the folding mechanism 400 lock or release the pull rod 513. The pull rod 513 is fixed at a stretching position when the limiting portion 5132*b* is locked by the locking part 430, and can move between a folding position and the stretching position when the limiting portion 5132*b* is released by the locking part 430. One end of the coupler head 100 is interconnected with a second end of the folding mechanism 400, and the coupler head 100 is configured to be connected externally to pull the vehicle.

In other words, the coupler assembly S mainly includes the mounting base 600, the buffering mechanism 500, the folding mechanism 400, and the coupler head 100. A first end (the right end shown in FIG. 1) of the mounting base 600 is configured to be mounted on one body of a straddle type rail train, for example, the mounting base 600 can be connected fixedly to the body of the straddle type rail train by bolts or in other similar ways. The buffering mechanism 500 extends along a horizontal direction (the left-right direction shown in FIG. 1), the first end (the right end shown in FIG. 1) of the buffering mechanism 500 is interconnected movably with a second end (the left end shown in FIG. 1) of the mounting base 600, consequently, by means of the mounting base 600 and the buffering mechanism 500, the connection between one end of the coupler assembly S and an adjacent body of the straddle rail train is realized, and moreover, mounting and dismounting are facilitated.

Further, the second end (the left end shown in FIG. 1) of the buffering mechanism 500 is provided with the pull rod 513, and a second end (a left end shown in FIG. 1) of the pull rod 513 is provided with the limiting portion 5132*b*. The first end (the right end shown in FIG. 1) of the folding mechanism 400 is interconnected movably with one end (the left end shown in FIG. 1) of the pull rod 513, and thereby the pull rod 513 can move between the folding position (the position shown in FIG. 2) and the stretching position (the position shown in FIG. 1). The second end (the left end shown in FIG. 1) of the folding mechanism 400 is interconnected with a first end (a right end shown in FIG. 1) of the coupler head 100, a second end of the coupler head 100 can be interconnected with another body of the straddle type rail train, and the coupler assembly S can then be connected to the other adjacent body of the straddle type rail train.

The folding mechanism 400 is provided with the locking part 430 capable of cooperating with the limiting portion 5132*b* of the pull rod 513, and configured to lock or release the limiting portion 5132*b*. When the pull rod 513 is in a stretched state, the locking part 430 cooperates with the limiting portion 5132*b* to lock the limiting portion 5132*b*, and thereby the pull rod 513 is fixed at the stretching position. When the pull rod 513 is in a non-stretched state, the locking part 430 is separated from the limiting portion 5132*b*, so that the pull rod 513 can move between the folding position and the stretching position, and operation is convenient.

In the coupler assembly S according to the embodiments of the disclosure, by movably interconnecting the folding mechanism 400 and the pull rod 513 and utilizing the effect of cooperation between the locking part 430 of the folding mechanism 400 and the limiting portion 5132*b* of the pull rod 513, the pull rod 513 is locked or released. When the pull rod 513 is located at the folding position, the locking part 430 is separated from the limiting portion 5132*b*, the pull rod 513 can move between the folding position and the stretching position, so the pull rod 513 can be folded conveniently. When the pull rod 513 is located at the stretching position, the locking part 430 is utilized to lock the limiting portion 5132*b*, so that the pull rod 513 can be fixed at the stretching position, consequently, the coupler assembly S can be configured to couple bodies of a train with large head width, the operation process is simple and convenient, and moreover, the requirement on an opening and closing device is low.

In some embodiments of the disclosure, the mounting base 600 is provided with a first assembly hole. The buffering mechanism 500 includes a buffer 510, an articulator 530, and a supporter 520. A first end of the buffer 510 is provided with a second assembly hole 5121, the pull rod 513 is disposed on the buffer 510, the articulator 530 passes through the first assembly hole and the second assembly hole 5121 to connect the mounting base 600 and the buffer 510. A first end of the supporter 520 is interconnected with the articulator 530, and a second end of the supporter 520 is interconnected with the buffer 510.

Figure 4:
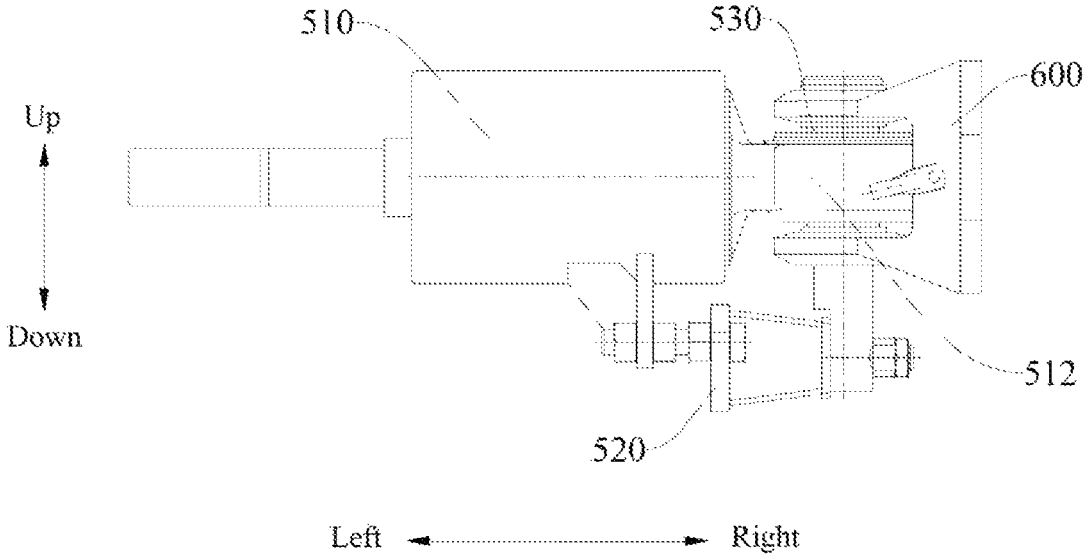
FIG. 4 is a schematic assembly diagram of a buffering mechanism and a mounting base of the coupler assembly according to the embodiments of the disclosure.

As shown in FIG. 4, the buffering mechanism 500 mainly includes the buffer 510, the articulator 530, and the supporter 520. The mounting base 600 is provided with the first assembly hole that is through along a vertical direction (the up-down direction shown in FIG. 4) and can cooperate with the articulator 530. The first end (the right end shown in FIG. 4 and FIG. 6) of the buffer 510 is provided with the second assembly hole 5121 that is through along the vertical direction (the up-down direction shown in FIG. 4) and can cooperate with the articulator 530. The articulator 530 is formed substantially into a column which extends along the vertical direction, and moreover, the column-shaped articulator 530 is inserted in the first assembly hole and the second assembly hole 5121, so that the second end (the left end shown in FIG. 4) of the mounting base 600 and the first end (the right end shown in FIG. 4) of the buffer 510 are interconnected movably through the articulator 530.

Figure 6:
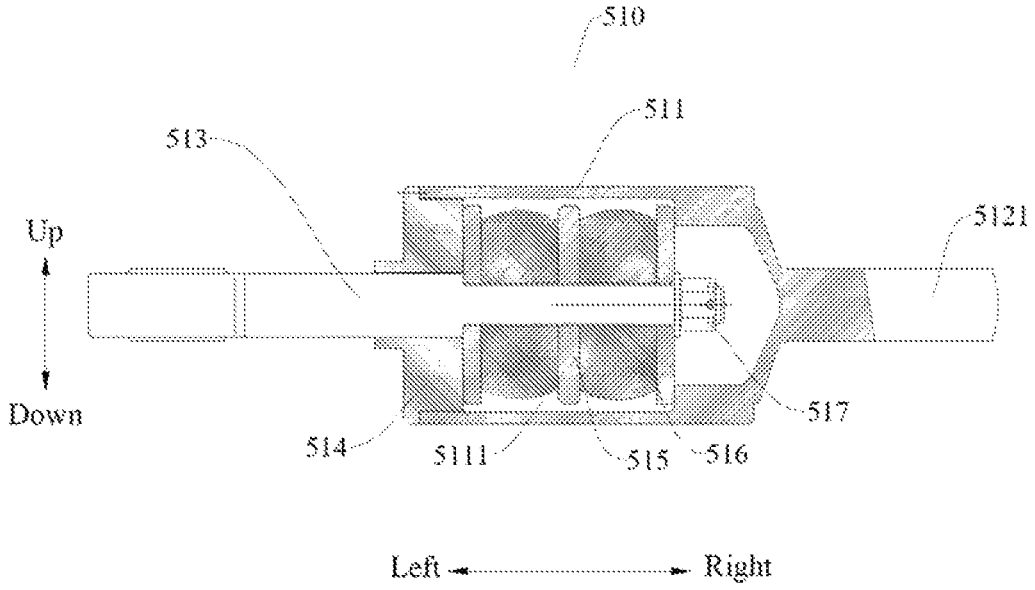
FIG. 6 is a section view of a buffer of the coupler assembly according to the embodiments of the disclosure.
Figure 7:
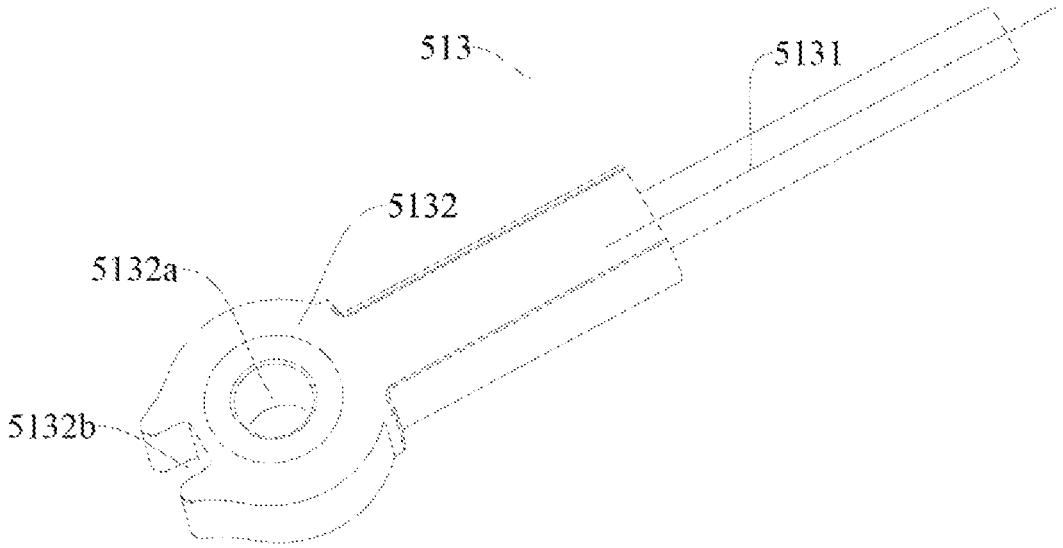
FIG. 7 is a structural schematic diagram of a pull rod of the coupler assembly according to the embodiments of the disclosure.

Referring to FIG. 6 and FIG. 7, a second end (a left end shown in FIG. 4) of the buffer 510 is provided with the pull rod 513 which extends along the horizontal direction (the left-right direction shown in FIG. 4), so the buffer 510 can be interconnected indirectly with one body of the straddle type rail train through the pull rod 513. The first end (the right end shown in FIG. 4) of the mounting base 600 can be interconnected with another body of the straddle type rail train, so that the adjacent bodies of the straddle type rail train are connected fixedly through the coupler assembly S, and thus the coupler assembly S is simple in structure and convenient to mount and dismount.

The first end (the right end shown in FIG. 4) of the supporter 520 is interconnected with a lower end of the articulator 530, the second end (the left end shown in FIG. 4) of the supporter 520 is interconnected with a lower end of the buffer 510, and thereby the buffer 510 is connected indirectly to the articulator 530 through the supporter 520. Meanwhile, an upper end of the articulator 530 is inserted in the first assembly hole of the mounting base 600 and the second assembly hole 5121 of the buffer 510 to connect upper ends of the mounting base 600 and the buffer 510, so that the buffer 510 is interconnected with two ends of the articulator 530 through the supporter 520 and the second assembly hole 5121, and thereby the mounting base 600 and the buffer 510 can be kept relatively horizontal, preventing the phenomenon of the buffer 510 being inclined downwardly relative to the mounting base 600 under the effect of gravity, and preventing vibrations and noise produced due to nonuniform stress between the buffer 510 and the articulator 530 during the running of the straddle type rail train.

The buffer 510 includes a cylinder 511, an end cap 514, multiple partitions 515, one or more cushions 516, and a fixing nut 517. A first end of the cylinder 511 is provided with a connecting portion 512, the connecting portion 512 is provided with the second assembly hole 5121, a second end of the cylinder 511 is open, and the interior of the cylinder 511 is provided with a chamber 5111 which extends to the second end of the cylinder 511 and is open at the second end of the cylinder 511. A first end of the pull rod 513 is disposed movably in the chamber 5111 along the axial direction of the cylinder 511, the end cap 514 is disposed on the cylinder 511 to seal the chamber 5111, and the end cap 514 is provided with a through hole suitable for the passage of the pull rod 513. The multiple partitions 515 are disposed at intervals along the axial direction of the pull rod 513 on a portion of the pull rod 513 which is located in the chamber 5111, the cushion 516 is disposed between the two adjacent partitions 515, and the fixing nut 517 is disposed at an end portion of the pull rod 513 located in the chamber 5111 to fix the partitions 515 and the cushion 516.

Referring to FIG. 6, the buffer 510 mainly includes the cylinder 511, the end cap 514, three partitions 515, two cushions 516, and the fixing nut 517. The cylinder 511 is formed substantially into a barrel which extends along the horizontal direction (the left-right direction shown in FIG. 6), and the chamber 5111, which extends horizontally and one end (the left end shown in FIG. 6) of which is open, is formed in the cylinder 511. The pull rod 513 is formed substantially into a column and the first end of the pull rod 513 is disposed movably in the chamber 5111 of the barrel-shaped cylinder 511, so that the pull rod 513 can move leftward or rightward relative to the cylinder 511 along the axial direction thereof (i.e. the left-right direction shown in FIG. 6) to play the role of buffering. The first end (the right end shown in FIG. 6) of the cylinder 511 is provided with the connecting portion 512, the connecting portion 512 is formed substantially into an annular structure to define the second assembly hole 5121, and the shape and size of the connecting portion 512 correspond to the shape and size of the articulator 530, thus ensuring mutual cooperation between the articulator 530 and the second assembly hole 5121 of the connecting portion 512.

The end cap 514 extends along the axial direction of the cylinder 511, and the size and shape of the end cap 514 correspond to the size and shape of the second end of the cylinder 511, thus sealing an opening of one side of the chamber 5111. The end cap 514 is provided with a through hole which is through along the axial direction, and the first end (the right end shown in FIG. 6) of the pull rod 513 passes through the through hole along the axial direction of the cylinder 511 and extends into the chamber 5111. Meanwhile, the first end of the pull rod 513 which extends into the chamber 5111 is provided with the three partitions 515 which are disposed at intervals along the axial direction, one cushion 516 is disposed between every two adjacent partitions 515, an end portion of the first end of the pull rod 513 extending into the chamber 5111 is provided with the fixing nut 517, and the partitions 515 and the cushions 516 are fixed by the fixing nut 517 located at the end portion of the first end (the right end shown in FIG. 6) of the pull rod 513.

Thus, the structure of the buffer 510 is simple and compact, not only can the chamber 5111 in the cylinder 511 be sealed by fixed connection between the end cap 514 and the second end of the cylinder 511 to protect parts in the chamber 5111, but also the degree of freedom of the pull rod 513 can be limited effectively, so that the pull rod 513 can move leftward or rightward along the axial direction within a certain range to compress the cushion 516 leftward or compress the cushion 516 rightward, and thereby a bidirectional buffering function of the coupler assembly S is achieved, ensuring that the coupler assembly S plays the role of buffering and energy absorption in the running process of the straddle type rail train, and achieving a protection effect.

When the coupler assembly S is in a stretched state (that is, the relative distance between the two adjacent bodies is increased), acting force produced by the bodies acts on the pull rod 513, the force is then transferred to the partition 515 located at the rightmost side of the pull rod 513 via fixed connection between the fixing nut 517 and the pull rod 513, and the rightmost partition 515 receives leftward pulling force to produce the trend of leftward motion. However, as the partition 515 located on the leftmost side of the pull rod 513 undergoes the limiting effect of the end cap 514, the cushion 516 between the two adjacent partitions 515 undergoes the pressure effect of the right partition 515 to produce compressive deformation, so that the coupler assembly S is stressed in balance, and thereby a buffering and energy absorption effect on body motion is achieved.

When the coupler assembly S is in a compressed state (that is, the relative distance between the two adjacent bodies is decreased), acting force produced by the bodies acts on the pull rod 513, and because of the fixed connection between the fixing nut 517 and the pull rod 513, the leftmost partition 515 receives leftward force to produce the trend of rightward motion. However, as the partition 515 located on the rightmost side of the pull rod 513 undergoes the limiting effect of an internal wall of the cylinder 511, the cushion 516 between the two adjacent partitions 515 undergoes the pressure effect of the left partition 515 to produce compressive deformation, so that the coupler assembly S is stressed in balance, and thereby a buffering and energy absorption effect on body motion is achieved.

In specific implementation, the articulator 530 includes a rotary shaft 531, a rubber bearing 532, and a sleeve 533. The rotary shaft 531 passes through the first assembly hole and the second assembly hole 5121 to connect the mounting base 600 and the buffer 510. The rubber bearing 532 is disposed in the second assembly hole 5121 and sleeves the rotary shaft 531, the sleeve 533 sleeves the rubber bearing 532, and an external wall surface of the sleeve 533 abuts against an internal wall surface of the second assembly hole 5121.

Figure 5:
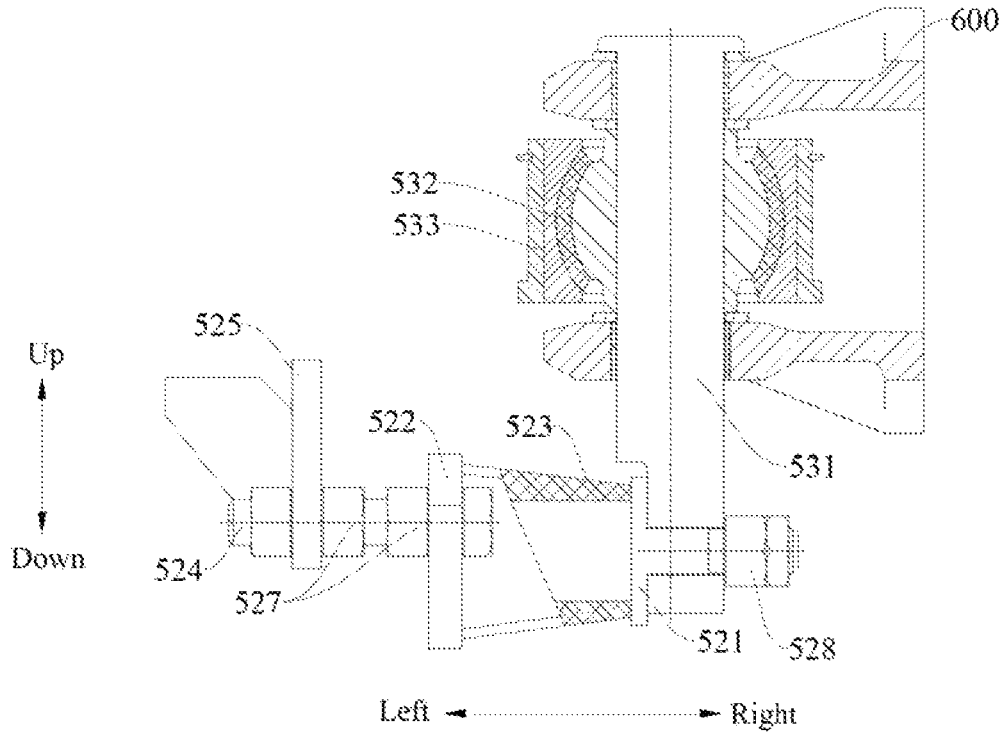
FIG. 5 is a partial section view after a partial structure of the buffering mechanism and the mounting base of the coupler assembly according to the embodiments of the disclosure after assembly are assembled.

As shown in FIG. 5, the articulator 530 mainly includes the rotary shaft 531, the rubber bearing 532, and the sleeve 533. The rotary shaft 531 is formed substantially into a columnar body which extends along a vertical direction (the up-down direction shown in FIG. 5), the radial dimension of the rotary shaft 531 is not greater than the radial dimensions of the first assembly hole and the second assembly hole 5121, and thereby the rotary shaft 531 can pass through the first assembly hole and the second assembly hole 5121 to connect the mounting base 600 and the buffer 510.

The rubber bearing 532 and the sleeve 533 are both formed substantially into a barrel-shaped structure. The rubber bearing mainly includes an inner race and an outer race, the radial dimension of the inner race of the rubber bearing 532 is substantially equal to the radial dimension of the rotary shaft 531, the radial dimension of the outer race of the rubber bearing 532 is substantially equal to the radial dimension of an internal wall surface of the sleeve 533, consequently, the inner race of the rubber bearing 532 is in fit connection with the rotary shaft 531, and the outer race of the rubber bearing 532 can abut against the internal wall surface of the sleeve 533 for connection. Meanwhile, the radial dimension of the external wall surface of the sleeve 533 is substantially equal to the radial dimension of the second assembly hole 5121, the internal wall surface of the second assembly hole 5121 abuts against the external wall surface of the sleeve, and thereby, the buffer 510 is connected indirectly to the rotary shaft 531 through the second assembly hole 5121.

Thus, by utilizing the buffering property of the rubber bearing 532, the buffer 510 interconnected therewith can horizontally swing and vertically move relative to the rotary shaft 531 within a certain range, thereby improving the buffering effect of the coupler assembly S and enhancing the adaptability of the coupler assembly S to curved sections and slope sections of a railway.

In specific implementation, the supporter 520 includes a first plate 521, a second plate 522, a rubber part 523, a connecting rod 524, and a connecting plate 525. The first plate 521 is interconnected with a lower end of the rotary shaft 531, the second plate 522 is spaced from the first plate 521, and the rubber part 523 is disposed between the first plate 521 and the second plate 522 to connect the first plate 521 and the second plate 522. A first end of the connecting rod 524 is interconnected with the second plate 522, the connecting plate 525 is interconnected with a second end of the connecting rod 524, and the connecting plate 525 is connected fixedly to an external wall surface of the buffer 510.

Referring to FIG. 4 and FIG. 5, the supporter 520 mainly includes the first plate 521, the second plate 522, the rubber part 523, the connecting rod 524, and the connecting plate 525. The first plate 521 is interconnected with the rotary shaft 531, and can be fastened by a fastening nut 528. The second plate 522 and the first plate 521 are spaced along the horizontal direction (the left-right direction shown in FIG. 5), the rubber part 523 is disposed between the second plate 522 and the first plate 521, and a first end (the right end shown in FIG. 5) of the rubber part 523 is interconnected with the first plate 521 and a second end (the left end shown in FIG. 5) is interconnected with the second plate 522, so that the first plate 521 and the second plate 522 are interconnected indirectly through the rubber part 523.

Further, the connecting rod 524 is formed substantially into a columnar body, the right end of the connecting rod 524 is interconnected with the second plate 522, and the left end of the connecting rod 524 is interconnected with the connecting plate 525. Meanwhile, the connecting plate 525 is interconnected with the external wall surface of the buffer 510, and thereby the whole supporter 520 is connected to the buffer 510 and the rotary shaft 531 through the connecting plate 525 and the first plate 521. Then the supporting effect of the supporter 520 on the buffer and the rotary shaft is utilized to ensure that the articulator 530 and the buffer 510 can be kept relatively horizontal during the running of the bodies, preventing the buffer 510 from drooping relative to the mounting base 600 under the effect of gravity to cause the buffer 510 and the articulator 530 to be stressed non-uniformly, consequently, vibrations and noise are reduced effectively, and the service life is prolonged.

In one embodiment of the disclosure, the supporter 520 further includes an adjusting nut 527, and the adjusting nut 527 is interconnected with the connecting rod 524 to adjust the motion of the connecting rod 524 along the thickness direction of the second plate 522.

As shown in FIG. 5, the adjusting nut 527 is interconnected with the connecting rod 524, the distance between the second plate 522 and the connecting plate 525 can be adjusted by the adjusting function of the adjusting nut 527, consequently, the permanent deformation of the rubber part 523 produced due to long-term stress or overload is counteracted, the buffer 510 and the mounting base 600 are kept relatively horizontal, and thereby the supporting effect of the supporter 520 is enhanced.

In the embodiment of the disclosure, the folding mechanism 400 includes a swivel arm 410, the swivel arm 410 includes an upper supporting arm 411, a lower supporting arm 412, and a connecting base 413, the upper supporting arm 411 and the lower supporting arm 412 are spaced from each other, and a first end of the upper supporting arm 411 and a first end of the lower supporting arm 412 are provided respectively with a first mounting hole 410*a*. The pull rod 513 is disposed movably between the upper supporting arm 411 and the lower supporting arm 412. The connecting base 413 is interconnected respectively with a second end of the upper supporting arm 411 and a second end of the lower supporting arm 412 to fix the upper supporting arm 411 and the lower supporting arm 412.

Figure 8:
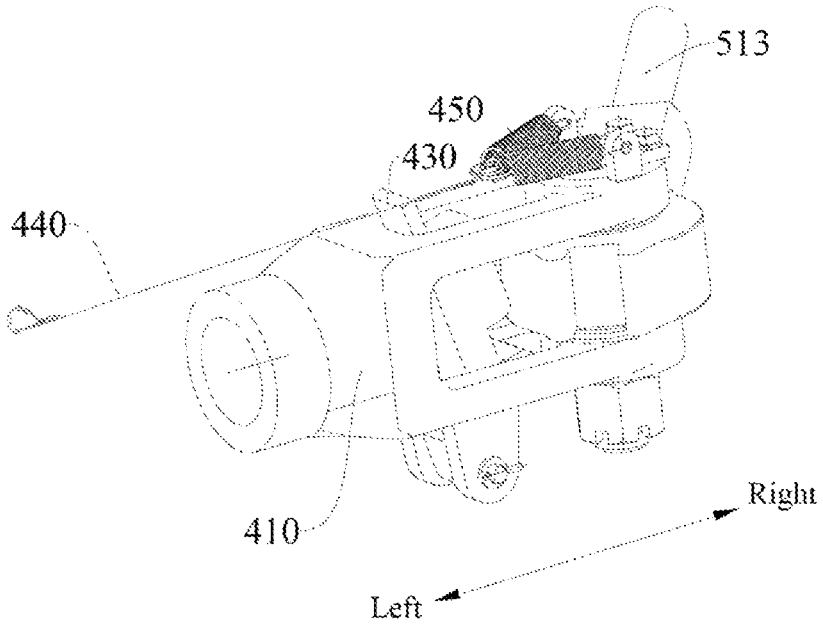
FIG. 8 is a schematic assembly diagram of a folding mechanism and the pull rod of the coupler assembly according to the embodiments of the disclosure.
Figure 9:
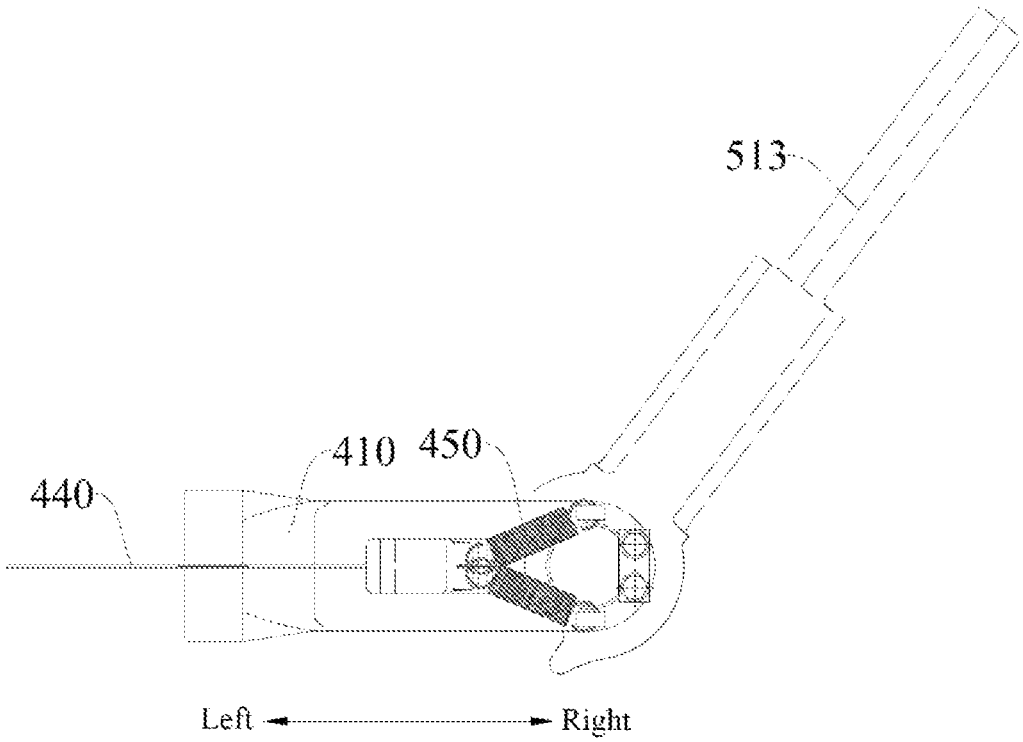
FIG. 9 is a schematic assembly diagram of the structure shown in FIG. 8 at another angle of view.
Figure 11:
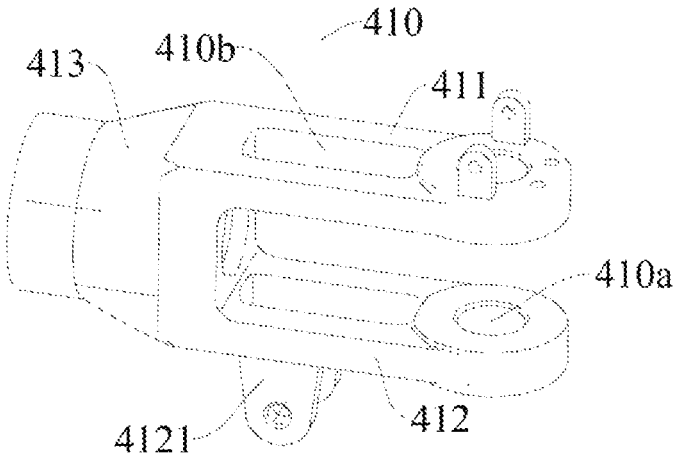
FIG. 11 is a structural schematic diagram of the folding mechanism of the coupler assembly according to the embodiments of the disclosure.

As shown in FIG. 8 and FIG. 11, the swivel arm 410 mainly includes the upper supporting arm 411, the lower supporting arm 412, and the connecting base 413, The upper supporting arm 411 and the lower supporting arm 412 are spaced and are opposite to each other, the second end of the upper supporting arm 411 and the second end of the lower supporting arm 412 are both interconnected with the connecting base 413, the first end of the upper supporting arm 411 is provided with the first mounting hole 410*a*, and the first end of the lower supporting arm 412 is provided with the first mounting hole 410*a* as well, that is, the free end of the upper supporting arm 411 and the free end of the lower supporting arm 412 are provided respectively with the first mounting hole 410*a*. The pull rod 513 is disposed between the upper supporting arm 411 and the lower supporting arm 412, that is, the pull rod 513 is located between the upper supporting arm 411 and the lower supporting arm 412.

The second end of the upper supporting arm 411 and the second end of the lower supporting arm 412 are interconnected respectively with the connecting base 413 to play the role of fixing the upper supporting arm 411 and the lower supporting arm 412. The first end of the upper supporting arm 411 and the first end of the lower supporting arm 412 are interconnected respectively with the pull rod through the first mounting holes 410*a* thereon, so that the puller rod 513 is connected movably to the swivel arm 410, consequently, the pull rod 513 can move relative to the upper supporting arm 411 and the lower supporting arm 412, that is, the pull rod 513 can move relative to the upper supporting arm 411 and the lower supporting arm 412 between the folding position and the stretching position, and thereby the stretching and folding actions of the coupler assembly S are realized.

The pull rod 513 includes a movable portion 5132, a bolt 5133, and a pull rod body 5131. The movable portion 5132 is disposed between the upper supporting arm 411 and the lower supporting arm 412, and the movable portion 5132 is provided with a second mounting hole 5132*a*. The limiting portion 5132*b* is disposed on the movable portion, the bolt 5133 passes through the first mounting hole 410*a* and the second mounting hole 5132*a* to movably connect the movable portion 5132 and the swivel arm 410. The pull rod body 5131 is interconnected with the movable portion 5132 and is configured to be stressed to pull the movable portion 5132 and the swivel arm 410.

Figure 10:
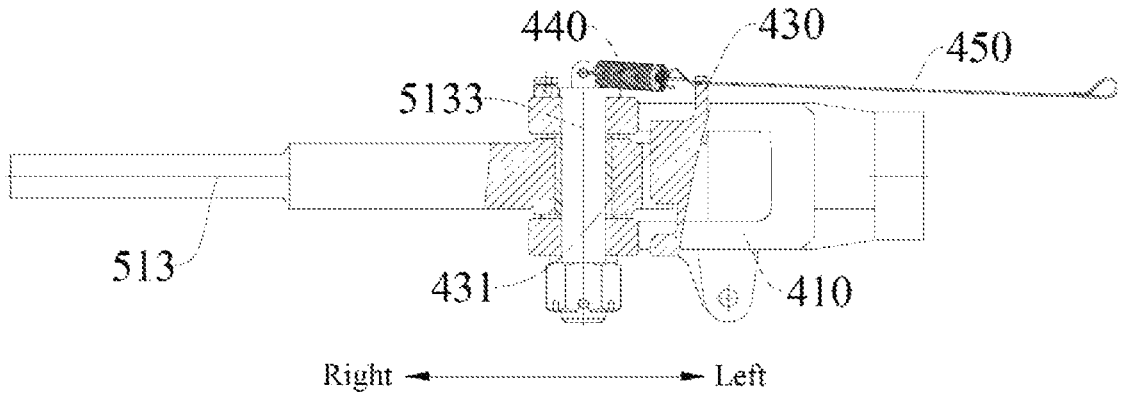
FIG. 10 is a partial section view after the folding mechanism and the pull rod of the coupler assembly according to the embodiments of the disclosure are assembled.

Referring to FIG. 7 and FIG. 10, the pull rod 513 mainly includes the movable portion 5132, the bolt 5133, and the pull rod body 5131. The movable portion 5132 is located between the upper supporting arm 411 and the lower supporting arm 412, the movable portion 5132 is provided with the second mounting hole 5132*a*, and the movable portion 5132 is also provided with the limiting portion 5132*b*. After the pull rod 513 and the swivel arm 410 are assembled, the bolt 5133 of the pull rod 513 is interconnected respectively with the first end of the upper supporting arm 411, the first end of the lower supporting arm 412 and the movable portion 5132, and thereby the pull rod body 5131 and the movable portion 5132 are interconnected with each other.

As shown in FIG. 10 and FIG. 11, by being inserted into the first mounting hole 410*a* of the upper supporting arm 411, the first mounting hole 410*a* of the lower supporting arm 412 and the second mounting hole 5132*a* of the movable portion 5132, the bolt 5133 interconnects the first end of the upper supporting arm 411, the first end of the lower supporting arm 412 and the movable portion 5132 together, so that the swivel arm 410 can rotate relative to the pull rod 513. When undergoing the effect of external force, the pull rod body 5131 of the pull rod 513 can pull the movable portion 5132 and the swivel arm 410 to realize the stretching and folding of the pull rod 513.

In one embodiment of the disclosure, the movable portion 5132 is formed substantially into a column, the second mounting hole 5132*a* is through along the axial direction thereof, and the limiting portion 5132*b* is disposed on an external wall surface of the movable portion 5132 and formed into an inwardly sunken limit notch. The locking part 430 is disposed movably on the swivel arm 410, the locking part 430 is provided with a baffle 431 which matches the limit notch, when located in the limit notch, the baffle 431 limits the rotation of the movable portion 5132, and when the baffle 431 is separated from the limit notch, the movable portion 5132 can rotate.

As shown in FIG. 7, the movable portion 5132 extends in a vertical direction and is disposed in the shape of a column, and the second mounting hole 5132*a* is disposed in the center of the movable portion 5132, and is through along the axial direction of the movable portion 5132. The limiting portion 5132*b* is also disposed on a periphery wall of the movable portion 5132, and the limiting portion 5132*b* forms a limit notch which is inwardly sunken relative to a periphery edge of the movable portion 5132. The locking part 430 is disposed on the swivel arm 410, the locking part 430 is provided with the baffle 431, the baffle 431 is disposed in a way of matching the limit notch on the movable portion 5132, and the locking part 430 can move relative to the swivel arm 410.

When the baffle 431 is located in the limit notch, the baffle 431 is fastened in the limit notch, so that the motion of the movable portion 5132 is limited, and at this moment, the pull rod 513 is in the stretched state. When the baffle 431 is separated from the limit notch, the baffle 431 cannot limit the movable portion 5132, that is, the movable portion 5132 can rotate around the bolt 5133, the pull rod 513 can move between the stretching position and the folding position, and therefore, not only is the structure simple, but also the stretching and folding process can be carried out conveniently.

In one embodiment of the disclosure, the upper supporting arm 411 and the lower supporting arm 412 are provided respectively with an avoiding slot 410*b* which extends along the axial direction thereof, and a lower wall surface of the lower supporting arm 412 is provided with a fixing base 4121. A lower end of the locking part 430 passes through the lower supporting arm 412 to pivotally interconnect with the fixing base 4121, at least one portion of an upper end of the locking part 430 extends into the avoiding slot 410*b* of the upper supporting arm 411, the baffle 431 is disposed on one side of the locking part 430 which faces the movable portion 5132, and the upper end of the locking part 430 is movable in the avoiding slot 410*b*, so that the baffle 431 cooperates with the movable part or gets out of the cooperation.

Referring to FIG. 11, the avoiding slots 410*b* are disposed respectively on the upper supporting arm 411 and the lower supporting arm 412, the avoiding slots 410*b* are disposed close to the first mounting holes 410*a*, and respectively extend along the length directions of the upper supporting arm 411 and the lower supporting arm 412, the avoiding slots 410*b* are respectively through along the thickness directions of the upper supporting arm 411 and the lower supporting arm 412, and the avoiding slot 410*b* on the upper supporting arm 411 and the avoiding slot 410*b* on the lower supporting arm 412 are disposed oppositely.

Further, the lower wall surface of the lower supporting arm 412 is provided with the fixing base 4121, and as shown in FIG. 11, the lower end of the locking part 430 can pass through the avoiding slot 410*b* on the lower supporting arm 412 to interconnect with the fixing base 4121, so that the locking part 430 is interconnected pivotally with the fixing base 4121. The upper end of the locking part 430 can pass through the avoiding slot 410*b* on the upper supporting arm 411 and extend out of the upper supporting arm 411, and one side of the baffle 431 on the locking part 430 is disposed facing one side of the movable portion 5132, that is, the baffle 431 is disposed facing one side of the limit notch on the movable portion 5132.

Thus, by extending at least one portion of the upper end of the locking part 430 into the avoiding slot 410*b* of the upper supporting arm 411, the upper end of the locking part 430 can move in the avoiding slot 410*b*. When the locking part 430 moves toward one side of the movable portion 5132, the baffle 431 is inserted into the limit notch, and the locking part 430 is in locking fit with the movable portion 5132. When the locking part 430 moves away from one side of the movable portion 5132, the baffle 431 gets out of the limit notch, and the locking part 430 is in release fit with the movable portion 5132.

The folding mechanism 400 further includes a pull rope 440 and an elastic part 450. The pull rope 400 is interconnected with the locking part 430 in order to drive the locking part 430 to pivot. The elastic part 450 is interconnected with the locking part 430 and located on one side of the locking part 430 which is opposite to the pull rope 440, and a first end of the elastic part 450 is fixed and a second end is interconnected with the locking part 430 to apply acting force, opposite to the direction of an acting force of the pull rope 440, on the locking part 430.

As shown in FIG. 8, the pull rope 440 is interconnected with the upper end of the locking part 430, the pull rope 440 is located on one side (the left side shown in FIG. 8) of the locking part 430, and by applying external force on the pull rope 440, the locking part 430 can pivot around the fixing base 4121, that is, the locking part 430 moves in the avoiding slot 410*b*. When the pull rope 440 applies pulling force on the upper end of the locking part 430, the locking part 430 pivots away from the movable portion 5132, the baffle 431 gets out of the limit notch, and the operation process is simple and convenient, and is very labor-saving through the function of the pull rope 440.

Further, the first end of the elastic part 450 is fixed on the upper supporting arm 411 of the swivel arm 410, the second end of the elastic part 450 is interconnected with the upper end of the locking part 430, the elastic part 450 is located on one side (the right side shown in FIG. 8) of the locking part which is opposite to the pull rope 440, that is, the connected ends of the pull rope 440 and the locking part 430 are on the same straight line as the connected ends of the elastic part 450 and the locking part 430, and the pull rope 440 is located on the left side of the locking part 430 and the elastic part 450 is located on the right side of the locking part 430.

The first end of the elastic part 450 is connected fixedly to an edge of the first mounting hole 410*a* of the upper supporting arm 411, acting force which is opposite to the direction of the acting force of the pull rope 440 can be applied on the locking part 430 through the connection between the elastic part 450 and the locking part 430, that is, when the pull rope 440 applies pulling force (the leftward acting force shown in FIG. 8) on the locking part 430, the elastic part 450 applies rightward acting force on the locking part 430, and when the pull rope 440 does not apply acting force on the locking part 430, the elastic part 450 applies leftward acting force on the locking part 430.

In addition, in some embodiments of the disclosure, the coupler assembly S further comprises a connecting mechanism 300, one end of the connecting mechanism 300 is interconnected fixedly with the other end of the folding mechanism 400, and the other end of the connecting mechanism 300 is connected to one end of the coupler head 100 through a snap ring 200.

Referring to FIG. 1, the connecting mechanism 300 is disposed between the coupler head 100 and the folding mechanism 400, a right end of the connecting mechanism 300 is interconnected with a left end of the folding mechanism 400, a left end of the connecting mechanism 300 is interconnected with a right end of the coupler head 100 through the snap ring 200, consequently, the coupler head 100 and the folding structure are connected indirectly into a whole through the connecting mechanism 300, and moreover, adopting the snap ring 100 for the connection between the connecting mechanism 300 and the coupler head 100 can also improve the convenience of assembly while ensuring the strength of connection.

Optionally, the coupler head 100 is a tight-lock coupler head.

Figure 12:
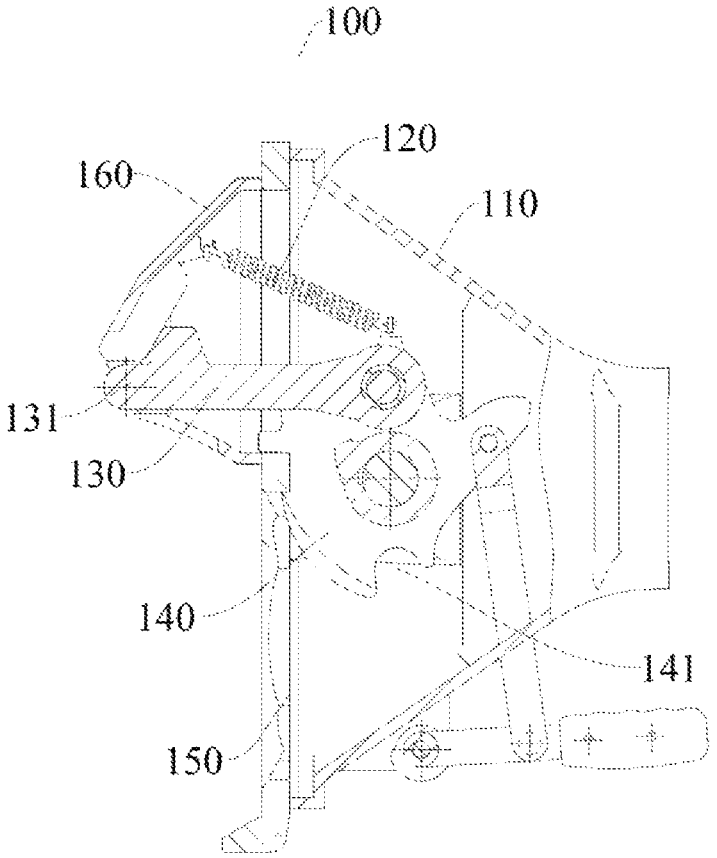
FIG. 12 is a structural schematic diagram of a sealed coupler head of the coupler assembly according to the embodiments of the disclosure.
Figure 13:
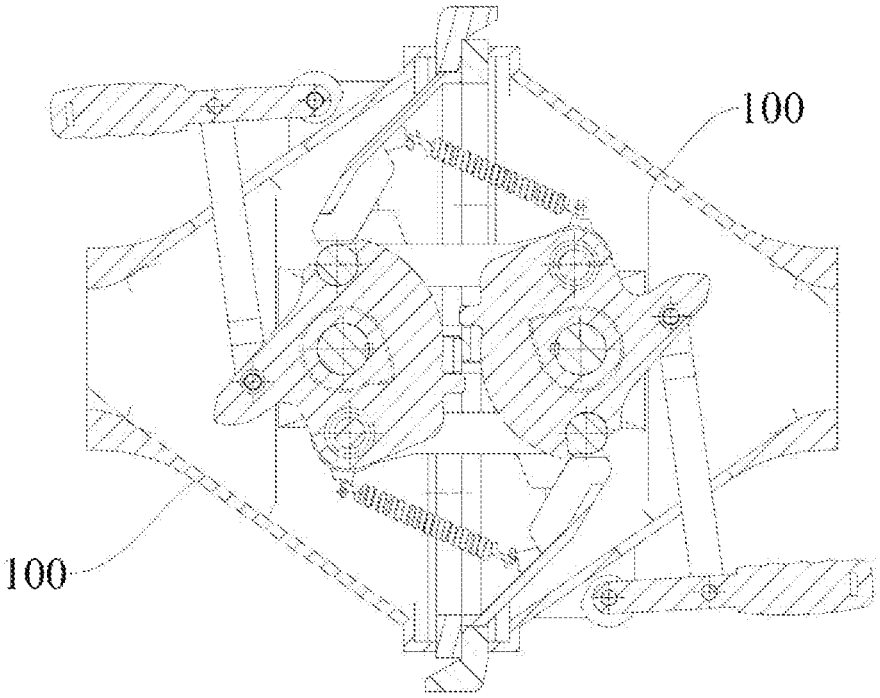
FIG. 13 is an assembly diagram of two sealed coupler heads of the coupler assemblies according to the embodiments of the disclosure in a coupled state.

Referring to FIG. 12 and FIG. 13, the tight-lock coupler head mainly includes a coupler body 110, a restoring spring 120, a coupler-locking link 130, and a coupler tongue plate 140. An accommodating space is defined in the coupler body 110, and the restoring spring 120, the coupler-locking link 130 and the coupler tongue plate 140 are all disposed in the accommodating space. The coupler body 110 is provided with a tapered concave portion 150 and a tapered convex portion 160, one end of the restoring spring 120 is interconnected with an internal wall of the tapered convex portion 160 of the coupler body 110, the other end is interconnected with the coupler tongue plate 140, the coupler tongue plate 140 is disposed at the middle of the coupler body 110, and can pivotally move relative to the coupler body 110, and one end of the coupler tongue plate 140 which is opposite to a joint of the coupler-locking link 130 is provided with a coupler tongue plate limit notch 141. One end of the coupler-locking link 130 is interconnected with an end portion of the coupler tongue plate 140, the other end is disposed in the tapered convex portion 160, the coupler-locking link 130 is provided with a limit head 131, and the coupler-locking link 130 can be driven by the coupler tongue plate 140 to move relative to the coupler body 110.

As shown in FIG. 13, when the coupler assemblies S on two adjacent bodies are coupled, the tapered convex portion 160 of the coupler head 100 of one end of the coupler assembly S located on the left side extends into the tapered concave portion 150 of the coupler head 100 of one end of the coupler assembly S located on the right side, the tapered convex portion 160 of the right coupler head 100 extends into the tapered concave portion 150 of the left coupler head 100, meanwhile, the coupler tongue plates 140 pivot, so that the coupler tongue plates 140 rotate clockwise until the limit heads 131 of the coupler-locking links 130 are fastened with the coupler tongue plate limit notches 141, at this moment, under the action of the restoring springs 120, the coupler-locking links 130 and the coupler tongue plates 140 can be connected through the cooperation between the limit heads 131 and the coupler tongue plate limit notches 141, and thereby the two coupler assemblies S are coupled, ensuring the reliability of connection between the adjacent bodies.

A straddle type rail train (not shown) according to embodiments of the second aspect of the disclosure includes the coupler assembly S according to the above embodiments, and as the coupler assembly S according to the above embodiments of the disclosure has the above technical effects, the straddle type rail train according to the embodiments of the disclosure also has the corresponding technical effects, that is, the straddle type rail train has the advantages of simple structure, attractive appearance, convenience in operation of coupler folding or coupling, and low requirement on the opening and closing device.

Specifically, by movably interconnecting the folding mechanism 400 and the pull rod 513 of the buffering mechanism 500 and utilizing the effect of cooperation between the locking part 430 of the folding mechanism 400 and the limiting portion 5132*b* of the pull rod 513, the pull rod 513 is locked or released. When the pull rod 513 is located at the folding position, the locking part 430 is separated from the limiting portion 5132*b*, the pull rod 513 can move between the folding position and the stretching position, so the pull rod 513 can be folded conveniently. When the pull rod 513 is located at the stretching position, the locking part 430 is utilized to lock the limiting portion 5132*b*, so that the pull rod 513 can be fixed at the stretching position, consequently, the coupler assembly S can be configured to couple bodies with large head width, the operation process is simple and convenient, and moreover, the requirement on the opening and closing device is low. The coupler assembly S has the advantages of simple structure, attractive appearance and low requirement on the opening and closing device.

The other configurations and operations of the coupler assembly S and the straddle type rail train with the same according to the embodiments of the disclosure are known to those of ordinary skill in the art, and therefore will not be described in detail herein.

In the description of the disclosure, it is to be understood that directions or positional relations indicated by terms, such as "center", "thickness", "upper", "lower", "front", "rear", "left", "right", "vertical", "horizontal", "top", "bottom", "internal", "external", "clockwise", "counterclockwise", "axial", "radial", "circumferential", etc., are based on directions or positional relations shown in the accompanying drawings, which are merely intended to conveniently describe the disclosure and simplify description rather than indicate or imply that the indicated device or element must have specific direction and be structured and operated according to the specific direction, and therefore should not be interpreted as limitations on the disclosure.

In addition, terms "first" and "second" are used only for description purposes, and shall not be understood as indicating or suggesting relative importance or implicitly indicating a quantity of indicated technical features. Therefore, features defined by "first" and "second" may explicitly or implicitly include at least one feature. In the description of the present disclosure, unless otherwise specifically limited, "multiple" means at least two, for example, two or three.

In the disclosure, unless clearly specified and defined otherwise, terms, such as "mount", "interconnect", "connect", "fix", etc., should be broadly comprehended, for example, as "fixedly connect", "detachably connect", "integrate", "mechanically connect", "electrically connect", "communicate with each other", "directly interconnect", "indirectly interconnect through an intermediate", "communicate between the interiors of two elements" or "have interactive relationship between two elements", unless clearly defined otherwise. A person of ordinary skill in the art may understand specific meanings of the foregoing terms in this disclosure according to a specific situation.

In the descriptions of this specification, descriptions such as reference terms "an embodiment", "some embodiments", "example", "specific example", or "some examples" intend to indicate that specific features, structures, materials, or characteristics described with reference to embodiments or examples are included in at least one embodiment or example of this disclosure. In this specification, exemplary descriptions of the foregoing terms do not necessarily refer to a same embodiment or example. In addition, the described specific features, structures, materials, or characteristics may be combined in a proper manner in any one or more of the embodiments or examples. In addition, a person skilled in the art may integrate or combine different embodiments or examples and characteristics of different embodiments or examples described in the specification, as long as they do not conflict each other.

Although the embodiments of the present disclosure are shown and described above, it can be understood that the foregoing embodiments are exemplary, and should not be construed as limitations to the present disclosure. A person of ordinary skill in the art can make changes, modifications, replacements, and variations to the foregoing embodiments within the scope of the present disclosure.

What is claimed is:

1. A coupler assembly, comprising:

a mounting base, wherein the mounting base is configured to be mounted on a vehicle and is provided with a first assembly hole;

a buffering mechanism, wherein one end of the buffering mechanism is interconnected movably with the mounting base, the other end of the buffering mechanism is provided with a pull rod, and the pull rod is provided with a limiting portion;

a folding mechanism, wherein one end of the folding mechanism is interconnected movably with the pull rod, the folding mechanism is provided with a locking part, the locking part movably cooperates with the limiting portion to lock or release the pull rod, and the pull rod is fixed at a stretching position when the limiting portion is locked by the locking part, and is movable between a folding position and the stretching position when the limiting portion is released by the locking part; and a coupler head, wherein one end of the coupler head is interconnected with the other end of the folding mechanism, and the coupler head is suitable for being connected externally to pull the vehicle, wherein the buffering mechanism comprises:

a buffer, wherein one end of the buffer is provided with a second assembly hole, and the pull rod being is disposed on the buffer;

an articulator, wherein the articulator passes through the first assembly hole and the second assembly hole to connect the mounting base and the buffer; and a supporter, wherein one end of the supporter is interconnected with the articulator, and the other end of the supporter is interconnected with the buffer.

2. The coupler assembly according to claim 1, wherein the buffer comprises:

a cylinder, wherein one end of the cylinder is provided with a connecting portion, the connecting portion is provided with the second assembly hole, the other end of the cylinder is open, the interior of the cylinder is provided with a chamber, the chamber extends to the other end of the cylinder and is open at the other end, and one end of the pull rod is disposed movably in the chamber along the axial direction of the cylinder;

an end cap, wherein the end cap is disposed on the cylinder to seal the chamber, and the end cap is provided with a through hole suitable for the passage of the pull rod;

a plurality of partitions, wherein the plurality of partitions are disposed at intervals along the axial direction of the pull rod on a portion of the pull rod which is located in the chamber;

one or more cushions, wherein the cushion is disposed between the two adjacent partitions; and a fixing nut, wherein the fixing nut is disposed at an end portion of one end of the pull rod located in the chamber to fix the partitions and the cushion.

3. The coupler assembly according to claim 1, wherein the articulator comprises:

a rotary shaft, wherein the rotary shaft passes through the first assembly hole and the second assembly hole to connect the mounting base and the buffer;

a rubber bearing, wherein the rubber bearing is disposed in the second assembly hole and sleeves the rotary shaft; and a sleeve, wherein the sleeve sleeves the rubber bearing, and an external wall surface of the sleeve abuts against an internal wall surface of the second assembly hole.

4. The coupler assembly according to claim 3, wherein the supporter comprises:

a first plate, wherein the first plate is interconnected with a lower end of the rotary shaft;

a second plate, wherein the second plate is spaced from the first plate;

a rubber part, wherein the rubber part is disposed between the first plate and the second plate to connect the first plate and the second plate;

a connecting rod, wherein one end of the connecting rod is interconnected with the second plate; and a connecting plate, wherein the connecting plate is interconnected with the other end of the connecting rod, and the connecting plate is connected fixedly to an external wall surface of the buffer.

5. The coupler assembly according to claim 4, wherein the supporter further comprises an adjusting nut, and the adjusting nut is interconnected with the connecting rod to adjust the motion of the connecting rod along the thickness direction of the second plate.

6. The coupler assembly according to claim 1, wherein the folding mechanism further comprises a swivel arm, and the swivel arm comprises:

an upper supporting arm and a lower supporting arm, wherein the upper supporting arm and the lower supporting arm are spaced from each other, one end of the upper supporting arm and one end of the lower supporting arm are provided respectively with a first mounting hole, and the pull rod is disposed movably between the upper supporting arm and the lower supporting arm; and a connecting base, wherein the connecting base is interconnected with the other ends of the upper supporting arm and the lower supporting arm to fix the upper supporting arm and the lower supporting arm.

7. The coupler assembly according to claim 6, wherein the pull rod comprises:

a movable portion, wherein the movable portion is disposed between the upper supporting arm and the lower supporting arm, the movable portion is provided with a second mounting hole, and the limiting portion is disposed on the movable portion;

a bolt, wherein the bolt passes through the first mounting hole and the second mounting hole to movably connect the movable portion and the swivel arm; and a pull rod body, wherein the pull rod body is interconnected with the movable portion and is suitable for being stressed to pull the movable portion and the swivel arm.

8. The coupler assembly according to claim 7, wherein the movable portion is formed substantially into a column, the second mounting hole pass through along the axial direction thereof, the limiting portion is disposed on an external wall surface of the movable portion and formed into an inwardly sunken limit notch, the locking part is disposed movably on the swivel arm, the locking part is provided with a baffle which matches the limit notch, the baffle limits the rotation of the movable portion when the baffle is located in the limit notch, and when the baffle is separated from the limit notch, the movable portion can rotate.

9. The coupler assembly according to claim 8, wherein the upper supporting arm and the lower supporting arm are provided respectively with an avoiding slot which extends along the axial direction thereof, a lower wall surface of the lower supporting arm is provided with a fixing base, a lower end of the locking part passes through the lower supporting arm to pivotally interconnect with the fixing base, at least one portion of an upper end of the locking part extends into the avoiding slot of the upper supporting arm, the baffle is disposed on one side of the locking part which faces the movable portion, and the upper end of the locking part is movable in the avoiding slot, so that the baffle cooperates with the movable part or gets out of cooperation.

10. The coupler assembly according to claim 9, wherein the folding mechanism further comprises a pull rope and an elastic part, and the pull rope is interconnected with the locking part to drive the locking part to pivot; the elastic part is interconnected with the locking part and located on one side of the locking part which is opposite to the pull rope, and one end of the elastic part is fixed and the other end is interconnected with the locking part to apply acting force, opposite to the direction of an acting force of the pull rope, on the locking part.

11. The coupler assembly according to claim 1, wherein the coupler assembly further comprises a connecting mechanism, one end of the connecting mechanism is interconnected fixedly with the other end of the folding mechanism, and the other end of the connecting mechanism is connected to one end of the coupler head through a snap ring.

12. The coupler assembly according to claim 1, wherein the coupler head is a tight-lock coupler head.

13. A straddle type rail train, comprising:

a body; and a coupler assembly, comprising:

a mounting base mounted on the body of the rail train, the mounting base being provided with a first assembly hole;

a buffering mechanism, wherein one end of the buffering mechanism is interconnected movably with the mounting base, the other end of the buffering mechanism is provided with a pull rod, and the pull rod is provided with a limiting portion;

a folding mechanism, wherein one end of the folding mechanism is interconnected movably with the pull rod, the folding mechanism is provided with a locking part, the locking part movably cooperates with the limiting portion to lock or release the pull rod, and the pull rod is fixed at a stretching position when the limiting portion is locked by the locking part, and is movable between a folding position and the stretching position when the limiting portion is released by the locking part; and a coupler head, wherein one end of the coupler head is interconnected with the other end of the folding mechanism, and the coupler head is suitable for being connected externally to pull the rail train, wherein the buffering mechanism comprises:

a buffer, wherein one end of the buffer is provided with a second assembly hole, and the pull rod being is disposed on the buffer;

an articulator, wherein the articulator passes through the first assembly hole and the second assembly hole to connect the mounting base and the buffer; and a supporter, wherein one end of the supporter is interconnected with the articulator, and the other end of the supporter is interconnected with the buffer.

14. The straddle type rail train according to claim 13, wherein the buffer comprises:

a cylinder, wherein one end of the cylinder is provided with a connecting portion, the connecting portion is provided with the second assembly hole, the other end of the cylinder is open, the interior of the cylinder is provided with a chamber, the chamber extends to the other end of the cylinder and is open at the other end, and one end of the pull rod is disposed movably in the chamber along the axial direction of the cylinder;

an end cap, wherein the end cap is disposed on the cylinder to seal the chamber, and the end cap is provided with a through hole suitable for the passage of the pull rod;

a plurality of partitions, wherein the plurality of partitions are disposed at intervals along the axial direction of the pull rod on a portion of the pull rod which is located in the chamber;

one or more cushions, wherein the cushion is disposed between the two adjacent partitions; and a fixing nut, wherein the fixing nut is disposed at an end portion of one end of the pull rod located in the chamber to fix the partitions and the cushion.

* * * * *